United States Patent [19]

Bangay et al.

[11] 4,110,892

[45] Sep. 5, 1978

[54] FABRICATION OF COPPER

[75] Inventors: Alan John Bangay, New Malden; Peter Michael Raw, Harrow; Rees Jenkin Llewellyn, Twickenham; Peter Gregory, Great Missenden, all of England

[73] Assignee: BICC Limited, London, England

[21] Appl. No.: 819,605

[22] Filed: Jul. 27, 1977

[30] Foreign Application Priority Data

Jul. 30, 1976 [GB] United Kingdom ..... 31763/76

[51] Int. Cl.[2] ..... B22F 3/24

[52] U.S. Cl. ..... 29/420; 148/16

[58] Field of Search ..... 29/420

[56] References Cited

U.S. PATENT DOCUMENTS

| | | | |
|---|---|---|---|
| 1,822,939 | 9/1931 | Stout | 75/208 R |
| 1,846,697 | 2/1932 | Stout, Jr. et al. | 204/52 R |
| 1,913,133 | 6/1933 | Stout | 75/212 |
| 1,938,608 | 12/1933 | Osborn et al. | 148/16 |

FOREIGN PATENT DOCUMENTS 551,594 6/1932 Fed. Rep. of Germany.

OTHER PUBLICATIONS

Copper, The Metal: Its Alloys and Compounds, Edited by A. Butts, American Chemical Society Monograph Series No. 122, Reinhold, N.Y. 1960, pp. 245–246, 362, 618–620.

Stout, AIME, Paper No. 1238, Oct. 1940.

Tyssowski, American Institute of Mining & Metallurgical Engineers, Paper No. 1217, (Feb. 1941).

The Extrusion of Metals, by C. E. Pearson & R. N. Parkins, Chapman & Hall Ltd., London 1960, pp. 326–329.

*Primary Examiner*—C.W. Lanham

*Assistant Examiner*—V. K. Rising

*Attorney, Agent, or Firm*—Buell, Blenko & Ziesenheim

[57] ABSTRACT

Elongate copper bodies, such as rods and wires, of electric conductor grade are made by electrodepositing copper as brittle cathodes which are then broken into fragments and fed as such to a continuously-acting friction-effected extrusion machine (such as Conform or Linex) which consolidates, bonds and extrudes them. The fragments have a specific surface area of about 25 - 1000 $mm^2/g$, and they are not subjected to any high-temperature purification or grain growth step prior to extrusion, though moderate pre-heating is allowed. Avoidance of high-temperature processing, such as conventional casting and hot-rolling, saves much energy and in addition copper of higher quality is produced.

12 Claims, 4 Drawing Figures

FABRICATION OF COPPER

This invention relates to the fabrication of elongate bodies of copper of electric conductor grade, which for avoidance of uncertainty can be taken to mean copper with a conductivity of at least 101% I.A.C.S. When the copper contains impurities of the usual kind, this corresponds to a total impurity level (counting oxygen an as impurity) in the region of 0.05% or below.

Copper of this quality is normally produced by electrolytic refining as flat, approximately rectangular cathodes and the conventional fabrication process involves melting the cathodes, casting (either continuously or discretely) into bars and hot-working (by swaging, rolling, extrusion or more than one of these processes) to elongate shape. In most cases cold drawing and/or rolling follows.

It has long been recognised that this process involves the use of large amounts of energy merely to raise the temperature of the copper to melt it and subsequently to maintain a suitable hot-working temperature, and has other disadvantages in particular that melting furnaces are very noisy and may also cause air pollution, and attempts have therefore been made to provide a low temperature fabrication process for the production of elongate products from unmelted cathode copper.

Most such attempts have been based on modification of the electrolytic refining process to form an elongate product directly. Though technically possible for some products, this has so far proved impracticable and/or uneconomic for the manufacture of electric conductors (except thin foils) because the area of the electrode is not efficiently utilised if parts are spaced sufficiently to avoid risk of adhesion and consequent failure, and the additives required in the electrolytic bath to control the shape of the product may have a deleterious effect on its electrical conductivity and/or the power consumption.

Another such attempt, which reached commercial use in the United States of America on a modest scale in the 1930's or thereabouts, but has since fallen into disuse, produced a product known as "coalesced copper". The coalesced copper process involved the deliberate production of brittle cathodes which were broken up into fragments which might be as large as several centimeters in each of their major dimensions and 5 mm thick. These fragments were compressed into briquettes, coalesced by heating for a substantial period under reducing conditions at around 900° C. to effect surface deoxidation, some other purification and grain growth, and subsequently hot-extruded to give a solid product of electric conductor grade. The present invention is based on the discovery that the heat treatment and coalescence step of this known process, which made it virtually impossible to adapt the process to continuous operation, was neither necessary nor beneficial and that fabricated products with superior properties can be obtained by a continuous process in which the particles of copper are directly consolidated by working at a relatively low temperature.

In accordance with the invention, a method of making an elongate body of copper of electric conductor grade comprises: electrodepositing copper in the form of brittle cathodes; breaking the cathodes into fragments with a mean specific surface area in the approximate range from 25 to 1000 $mm^2/g$; feeding these fragments as such and without any high temperature treatment for purification or grain growth to a continuously acting friction-effected extrusion machine and by means of that machine working the fragments under pressure sufficiently to consolidate and bond the fragments into a continuous elongate body.

If desired brittle cathode can be produced by the known technique in which the starting sheet on which the cathode is to be deposited is first coated with a thin layer of an insoluble non-metallic material such as a metallic soap, mineral oil paste or mixture, paraffin (Kerosene), corn oil or an emulsion of mercaptopropionic acid in caproic acid and cetyl alcohol.

We believe however that these coatings function by insulating a large proportion of the area of the starting sheet and thereby increasing the true current density in those areas where the coating is discontinuous or porous, and we have found that better results can be obtained, without risk of contaminating the cathode copper with a coating material, by applying a sufficiently high current density, at least initially, to the whole area of the untreated starting sheet. The current density required will depend on the electrolyte composition, temperature and other conditions but for a bath of conventional composition (apart from the omision of additives conventionally used to promote deposition in a ductile condition) a current density in the range 400 – 1000 $Am^{-2}$ is likely to be satisfactory for the initial deposition; the current density may be reduced considerably, often to conventional levels, once the structure of the deposit has become established.

The brittle cathodes will normally need to be washed on withdrawal from the electrolyte, at any rate when this is a conventional aqueous acid sulphate composition, to avoid risk of contamination, corrosion etc.

The brittle cathodes will usually be broken by impact, tension, bending or some combination of these effects; cutting processes such as single-action shearing, sawing and flame-cutting are excluded because their energy requirements are too high. More specifically a jaw crusher, a hammer mill, a tooth mill (i.e. a roll pass with meshing studded or ribbed rolls) or a tumbling mill can be used; jaw crushers are preferred for extremely brittle cathodes, but hammer mills appear to be better for processing cathodes that are only moderately brittle.

Fragments of the specific surface area defined will include dense fragments varying from granules about 1 $mm^3$ to slabs about 100 mm square by 10 mm thick, and proportionately larger for porous fragments. Usually at least one dimesion of each fragment, namely that corresponding to the thickness of the cathode initially produced, will be no greater than 10 mm and in most cases no greater than 5 mm. Oversize fragments can be screened out and recycled for further reduction; a proportion of fine fragments is acceptable.

A further washing step preferably follows the breaking up of the cathode copper to remove any occluded electrolyte or other impurity that may have been released.

After drying if required, the fragments may be fed directly to the extrusion machine. They are preferably supplied to the machine at around ambient temperature, but a moderate degree of pre-heating can be used if required to reduce extrusion pressure, but heating sufficient to produce grain growth or to cause dissolution of particulate impurities is to be avoided; we prefer not to heat above 700° C. even for a short period. If any significant pre-heating is used a reducing, or at least non-oxidising, atmosphere will be required for the heating furnace, but the extrusion machine may operate in the ambient atmosphere in some cases.

The friction-effected extrusion processes, of which the most familiar are those known by the proprietary names "Conform", "Linex" and "Extrolling", operate without a closed billet chamber, and the metal, instead of being forced into the extrusion die by a ram or by fluid pressure, is gripped by a member or members of the enclosure that are advanced towards the die and so thrust the metal into the die mouth, where it upsets and extrudes through the die. Because no stoppages for billet insertion are required, they can operate continuously and at a high speed for long periods. A fuller description of the Conform and Linex processes will be found in the Wire Journal, April 1976 pp 64– 69 and the Conform process is the subject of British Pat. Nos. 1,370,894 and 1,434,201.

Preferably the extrusion ratio is at least 8:1 for a preheat temperature of 400° C. or above and at least 10:1 for operation without any pre-heating. The elongate product may be a semi-finished or a finished product: for instance may be a round rod, a shaped profile or a wire; or a number of wires (or small profiles) can be extruded simultaneously, multiple products making it easier to achieve the required extrusion ratio in many cases.

For a given overall impurity content, the fabricated copper products made by the method of the invention have a higher electrical conductivity than products made by any commercial process at present in use. Alternatively copper products of electrical grade can be made from cathodes with an impurity level higher than would normally be acceptable.

Fabricated copper products made by the method of the invention also have an excellent response to annealing. Annealing conditions must of course be within the limits imposed by the dissolution of impurities, but this presents no difficulty.

The invention will be further described, with reference to the accompanying drawings in which FIG. 1 is a flow diagram illustrating the invention;

Figure 1:
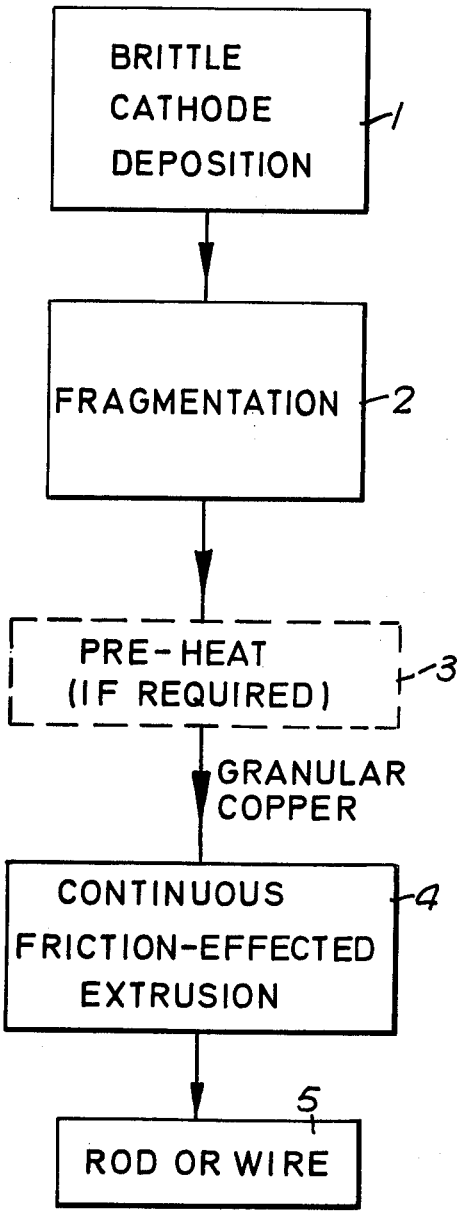

FIG. 1 illustrates the main steps of the process of the invention, namely brittle cathode deposition 1; fragmentation 2; pre-heating 3 (not necessary in all cases); and continuous friction-effected extrusion 4 to produce an elongate product such as rod or wire 5.

The various steps will now be discussed individually and partly by way of example.

Figure 2:
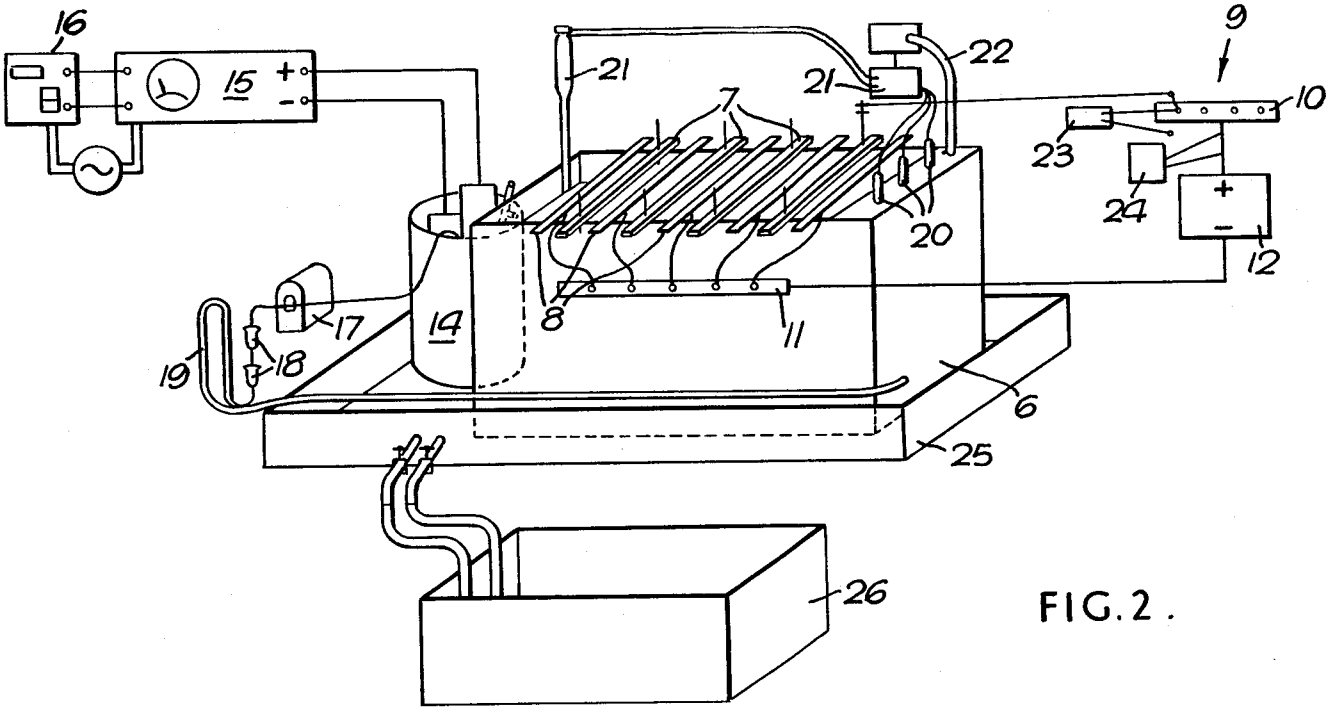
FIG. 2 is a sketch of a pilot electro-refining plant.

FIG. 2 shows the pilot plant in which the electrodeposition of brittle cathode copper has been studied.

The main components are a suitably framed polypropylene cell 6 measuring 0.6 × 0.3 × 0.3m, equipped with anode hanger bars 7 alternating with cathode hanger bars 8 all of which are adjustable along the length of the cell and with current supply equipment 9 comprising anode and cathode bus-bars 10, 11 connected to a D.C. source 12.

Conventional accessories include:

(a) a liberator cell 14 with its own power supply unit 15 and instrumentation 16 and a circulation system including a pump 17 with filters 18 and a flowmeter 19; this is used with a lead anode in the usual way to prevent accumulation of increasing amounts of copper in the electrolyte;

(b) electrolyte heaters 20 controlled by a thermostat 21 and with a low-electrolyte cut-out 2; and (c) observational instruments such as a digital voltmeter 23 and current integrator 24.

Both the cells (6 and 14) stand in an acid-resistant spillage tray 25 connected to a storage sump 26.

The pilot plant was operated with an aqueous acid sulphate electrolyte containing 30 g/l of copper calculated as metal and 120 g/l of free acid (calculated as $H_2SO_4$), without any additives, at a uniform temperature of 40° C. (lower them for conventional ductile copper deposition) and a circulation rate of 1.2 ml/s.

Copper anodes measuring 230 × 230 × 12.7 mm were used with cathode mother blanks of the customary titanium measuring 280 mm high × 235mm wide × 3.2 mm; these were hung conductive droppers from their respective hanger bars, and adjusted to a uniform spacing of 100 mm centers.

Under these conditions an initial cathode current density of not less than 400 $Am^{-2}$ and preferably at least 500 $Am^{31\ 2}$ is needed to obtain an acceptable copper deposit, and we prefer to use an initial cathode current density of about 600 l $Am^{-2}$. Higher values, up to about 1000 $Am^{-2}$ at least, can be used but are not considered beneficial. Particularly good results have been obtained with the following current density sequence:

| deposition time: | Current density ($Am^{-2}$) |
|---|---|
| start to 10 minutes | 606 |
| 10 minutes to 4½ hours | 415 |
| 4½ to 22½ hours | 287 |
| 22½ hours onwards | 255 |

The final current density of 255$Am^{-2}$ can be continued as long as necessary (several days) to obtain the required thickness of deposit, say 5 – 10 mm.

After removing from the bath, the mother blank with the copper deposit on it is washed with hot water until subtantially free of corrosive electrolyte. After breaking away copper from the edges of the titanium mother blank (if the edges were not masked) the copper can be stripped by hand from each of the major surfaces intact, or in a small number of pieces.

When the current-density sequence set out above is used, the copper is so brittle that after stripping from the mother blank it can easily be broken up by gripping and bending between the hands.

Brittle cathode prepared in this way has been successfully crushed to polycrystalline fragments small enough to pass a 10mm mesh but mostly exceeding 1mm using commercially — available comminuting machinery. Cathodes prepared using the current-density sequence set out have been comminuted in a jaw crusher such as the one available from Glen Creston Ltd., (16 Carlisle Road, Colindale, London NW9, England) as model BB2/A jaw crusher, fitted with manganese steel jaws set one tenth of an inch (2.54mm) apart. Cathodes produced with a similar sequence apart from the omission of the initial 606 $Am^{-2}$ step could not be crushed in this way but fragment readily in a hammer mill, for example Cross-Beater mill model SK1 or the larger Ideal Triumph Mill No. 2, also available from Glen Creston Ltd. When possible jaw crushing is preferred because it involves less cold working of the metal and runs less risk of the ferrous contamination.

Comminution is preferably followed by a further washing step and magnetic separation (especially if a hammer mill was used), and if necessary by drying.

Provided that the extrusion machinery is capable of processing the cold fragments they may be passed directly to it, but otherwise they are pre-heated in any suitable kind of furnace under an inert or reducing atmosphere ot a suitable extrusion temperature, say up to about 450° C. An atmosphere of cracked ammonia is preferred, but steam is also suitable, especially for lower pre-heat temperatures. The temperature/time conditions in this pre-heating step (and pressure conditions if the fragments are subject to pressure from the weight of a layer of the fragments or otherwise) must be such that no significant grain-growth or fragment-to-fragment bonding occurs, and no substantial degree of deoxidation will take place under these conditions. When the required extrusion temperature is reached, the fragments are desirably fed to the extrusion machine as quickly as possible.

Figure 3:
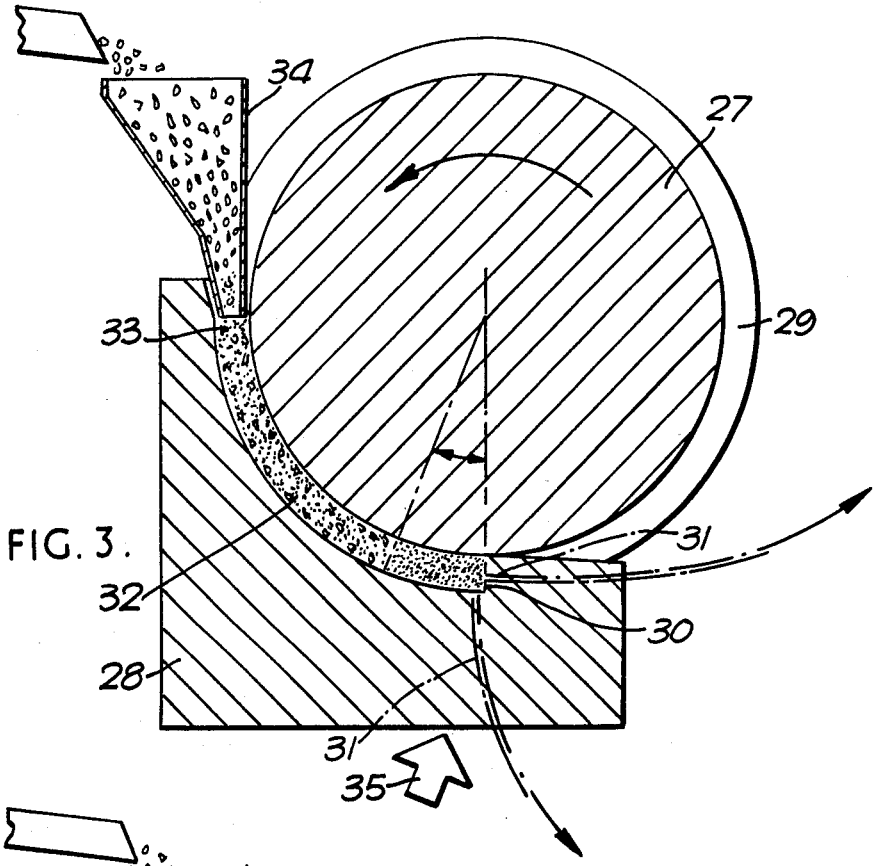
FIGS. 3 and 4 are simplified drawings of two different types of apparatus for friction-effected extrusion.
Figure 4:
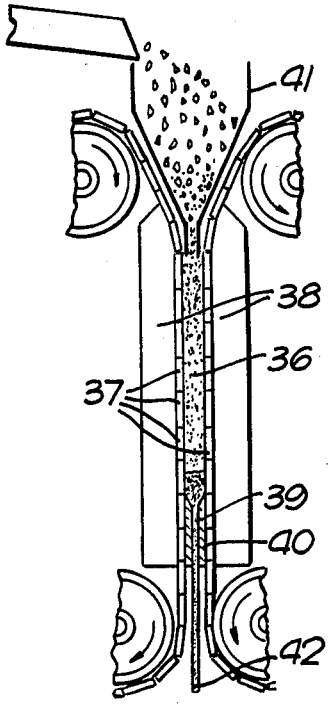

FIGS. 3 and 4 show two different types of friction-effected extrusion machine that can be used.

FIG. 3 shows a "Conform" machine consisting essentially of a grooved driven wheel 27 and a stationary shoe 28 that encloses the groove 29 over about one quarter of its periphery and closes the enclosed portion at one end 30, apart from a die opening 31 (alternative positions of which are shown) to form a pressure chamber 32. The orientation of the machine is chosen so that the inlet 33 faces upwards to accept a continuous feed of copper particles though a simple hopper 34. The particles are carried forward by the frictional force applied by the walls of the groove 29, which have a greater area in the pressure chamber than that of the shoe 28, and sufficient pressure is generated to consolidate the particles and bond them into a coherent non-porous body and to extrude that body through the die opening. It will be appreciated that the wheel bearings will need to withstand a considerable force due to the pressure of the metal and that the shoe needs to be held in place by a restraining force in the direction of arrow 35.

The "Linex" machine shown in FIG. 4 is similar in principle, but the pressure chamber is straight and rectangular with its wider faces constituted by a series of gripper blocks 37 articulated as endless belts and bearing on pressure pads 38. The narrow faces are constituted by stationary walls (not visible in the sketch) that are preferably lubricated, and the extrusion die 39 is supported by a fork 40. Copper particles are continuously fed through a hopper 41 and the extruded product 42 emerges downwards.

In a specific example, brittle cathode copper prepared as described above, containing about 1ppm silver, 28ppm sulphur, 0.2ppm selenium and 130 ppm oxygen (ppm = parts per million) was broken until it passed a 6.5 mm mesh and then extruded using the type of machine shown in FIG. 3 into rod 5.08mm in diameter, at an extrusion ratio of 12:1. The highest temperature reached by the copper was about 480° C. After cold-drawing to 0.5mm diameter wire, the conductivity was measured and found to be 102.4% IACS.

What we claim as our invention is:

1. A method of making an elongate body of copper of electric conductor grade comprising: electrodepositing copper in the form of brittle cathodes; breaking the cathodes into fragments with a mean specific surface area in the approximate range from 25 to 1000 $mm^2/g$; feeding these fragments as such and without any high temperature treatment for purification or grain growth to a continuously acting friction-effected extrusion machine and by means of that machine working the fragments under pressure sufficiently to consolidate and bond the fragments into a continuous elongate body.

2. A method is claimed in claim 1 in which the copper is electrodeposited on a mother blank that has been coated with a thin layer of an insoluble non-metallic material.

3. A method as claimed in claim 1 or claim 2 in which the layer is selected from the class consisting of metallic soaps, mineral oil pastes and mixtures, kerosene, corn oil or an emulsion of mercaptopropionic acid in caproic acid and cetyl alcohol.

4. A method of making an elongate body of copper of electric conductor grade comprising: electrodepositing copper from an acid copper sulphate electrolyte at an initial current density exceeding 400 $Am^{-2}$ and sufficient to obtain brittle cathodes; breaking the cathodes into fragments with a mean specific surface area in the approximate range from 25 to 1000 $mm^2/g$; feeding these fragments as such and without any high temperature treatment for purification of grain growth to a continuously acting friction-effected extrusion machine and by means of that machine working the fragments under pressure sufficiently to consolidate and bond the fragments into a continuous elongate body.

5. A method as claimed in claim 4 in which the initial current density is the range 400 – 1000 $Am^{-2}$.

6. A method as claimed in claim 4 in which the initial current density is in the range 500 – 1000 $Am^{-2}$.

7. A method as claimed in claim 1 in which the fragments are supplied to the extrusion machine substantially ambient temperature.

8. A method as claimed in claim 7 in which the extrusion ratio is at least 10:1.

9. A method as claimed in claim 1 in which the fragments are pre-heated in a non-oxidising atmosphere to a temperature above ambient but below that at which any substantial grain growth or dissolution of impurities will occur.

10. A method as claimed in claim 8 in which the copper is never heated above 700° C.

11. A method as claimed in claim 10 in which the fragments are pre-heated to at least 400° C. and the extrusion ratio is at least 8:1.

12. Elongate copper bodies of electric conductor grade made by the method claimed in claim 1.

* * * * *

UNITED STATES PATENT OFFICE

CERTIFICATE OF CORRECTION

Patent No. 4,110,892 Dated September 5, 1978

Inventor(s) Alan John Bangay et al.

It is certified that error appears in the above-identified patent and that said Letters Patent are hereby corrected as shown below:

Column 4, line 22, "500 Am $^{31\ 2}$" should be -- 500 $Am^{-2}$ --.

Column 4, line 24, delete "1" after "600".

Claim 4, column 6, line 33, after "purification", "of" should be -- or --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*